US011952770B2

(12) United States Patent
Taylor et al.

(10) Patent No.: US 11,952,770 B2
(45) Date of Patent: Apr. 9, 2024

(54) SYSTEM AND METHOD FOR RETAINING A DECORATIVE FIN

(71) Applicant: N.R. Windows, Inc., Wes Palm Beach, FL (US)

(72) Inventors: David Taylor, West Palm Beach, FL (US); Arnel Austria, West Palm Beach, FL (US)

(73) Assignee: N.R. Windows, Inc., West Palm Beach, FL (US)

( * ) Notice: Subject to any disclaimer, the term of this patent is extended or adjusted under 35 U.S.C. 154(b) by 0 days.

(21) Appl. No.: 17/723,392

(22) Filed: Apr. 18, 2022

(65) Prior Publication Data

US 2023/0243148 A1 Aug. 3, 2023

Related U.S. Application Data

(60) Provisional application No. 63/267,518, filed on Feb. 3, 2022.

(51) Int. Cl.
*E04B 1/346* (2006.01)
*E04B 1/38* (2006.01)
(Continued)

(52) U.S. Cl.
CPC ..... *E04B 1/388* (2023.08); *E04F 10/00* (2013.01); *E04F 13/0832* (2013.01); *E04B 2001/389* (2023.08)

(58) Field of Classification Search
CPC ..... E04B 1/40; E04B 2001/405; E04B 1/388; E04F 10/00; E04F 13/0832
(Continued)

(56) References Cited

U.S. PATENT DOCUMENTS 211,003 A * 12/1878 Dunbar ..... A01B 35/24
172/711
680,336 A * 8/1901 Linton ..... H01H 9/102
337/9

(Continued)

FOREIGN PATENT DOCUMENTS

| | | |
|---|---|---|
| CN | 207999015 | † 10/2018 |
| EP | 3563737 | † 11/2019 |
| WO | 2019028523 | † 2/2019 |

OTHER PUBLICATIONS

Metalline, Architectural Fins: What to consider when specifying, 1 page, Nov. 26, 2019, Metalline Architectural Fabrications (https://www.metalline.co.uk/blog/architectural-fins-what-to-consider-when-specifying/).†

*Primary Examiner* — Basil S Katcheves
(74) *Attorney, Agent, or Firm* — Welsh IP Law LLC

(57) ABSTRACT

A system for retaining a position of an architectural fin relative to a structure. The fin is generally planar and defines an edge. The system includes a first mounting bracket configured to retain the architectural fin. The first mounting bracket comprises a first element having laterally opposed surfaces configured to receive the architectural fin therebetween and to apply a compression force to the laterally opposed surfaces of the architectural fin. A second element connected to the first element so that the first element is rotatable relative to the second element about an axis of rotation of the first mounting bracket. The second element has a base for fixing the first mounting bracket relative to the structure. The first mounting bracket is configured to enable rotation of the architectural fin relative to the structure about the axis of rotation of the first mounting bracket.

11 Claims, 6 Drawing Sheets

(51) Int. Cl.
*E04F 10/00* (2006.01)
*E04F 13/08* (2006.01)

(58) Field of Classification Search
USPC ..... 52/651.1, 24
See application file for complete search history.

(56) References Cited

U.S. PATENT DOCUMENTS 1,587,089 A * 6/1926 Thomson ..... E04B 1/40 403/217
1,846,872 A * 2/1932 Isaacson ..... E04B 1/40 52/256
2,629,906 A * 2/1953 Holmes ..... E04B 1/2604 403/187
4,428,437 A * 1/1984 Steinberg ..... A01B 35/28 172/551
4,449,335 A * 5/1984 Fahey ..... E04B 1/2612 52/713
5,228,667 A * 7/1993 Bridegum ..... E04D 13/158 269/45
5,788,204 A * 8/1998 Goodwin ..... E04G 5/02 248/237
6,704,966 B1 * 3/2004 Kao ..... E05D 11/1064 16/334
6,766,561 B1 * 7/2004 Cheng ..... E05D 11/00 16/382
7,188,390 B2 * 3/2007 Cheng ..... E05D 7/0415 16/241
8,046,873 B2 * 11/2011 Chang ..... E05D 11/105 16/281
8,113,479 B1 * 2/2012 O'Connell ..... E04G 25/06 248/351
8,720,005 B2 * 5/2014 Cheng ..... E05D 5/0246 16/54
8,893,445 B2 * 11/2014 Yen ..... H02S 20/30 52/173.3
9,140,043 B2 * 9/2015 Chang ..... E05D 11/1064
9,175,472 B1 * 11/2015 Calini ..... E04B 1/40
9,297,191 B1 * 3/2016 Chen ..... E05F 3/12
9,422,757 B2 * 8/2016 Bacchetti ..... E05D 11/1028
10,480,230 B2 * 11/2019 Brun ..... E05D 5/12
10,954,674 B2 * 3/2021 Header ..... E04D 13/103
11,149,431 B1 * 10/2021 Meznarich ..... E04B 1/40
2008/0121273 A1 * 5/2008 Plaisted ..... H02S 20/24 136/251
2009/0183443 A1 † 7/2009 Osborn et al.
2010/0281785 A1 * 11/2010 Kaiser ..... E04D 13/00 52/24
2017/0175380 A1 * 6/2017 Nehls ..... E04B 1/40
2020/0291643 A1 * 9/2020 Marlow ..... E04B 1/2604
2021/0270301 A1 † 9/2021 Park et al.
2022/0316203 A1 * 10/2022 Noguchi ..... E04B 1/2604
2023/0151607 A1 † 5/2023 Magin et al.

* cited by examiner
† cited by third party

SYSTEM AND METHOD FOR RETAINING A DECORATIVE FIN

TECHNICAL FIELD

The present disclosure generally relates to decorative fins. More specifically, the present disclosure relates to a system for retaining decorative fins relative to a structure.

BACKGROUND

Decorative fins are provided on the exterior or interior of a surface of a structure. Decorative fins may also be referred to as glass fins, architectural fins, sunshades, and glass sunshades.

In reference to FIG. 1, an example of a façade 20 of building 10 is shown. A plurality of decorative fins 30 is fixed to the façade of the building. In the embodiment disclosed in FIG. 1, the fins 30 are generally planar and are aligned in vertical columns along the side of the building 10. Each fin 30 forms an angle relative to the building 10. The angle of the fin 30 relative to the building is fixed. In the embodiment disclosed in FIG. 1, the decorative fins are glass, although the present invention is not limited in this regard and other materials may be used.

The decorative fins may have multiple different functions. For example, they have an aesthetic function. They may also serve to deflect radiant heat energy of the sun. The fins may be perpendicular to the surface of the building. In other embodiments, the fins may be positioned at an angle relative to the building.

SUMMARY

The needs set forth herein as well as further and other needs and advantages are addressed by the present teachings, which illustrate solutions and advantages described below.

The present invention resides in on aspect in a system for retaining a position of an architectural fin relative to a structure. The architectural fin is generally planar and defines an edge extending between two laterally opposed surfaces. The system comprises a first mounting bracket configured to retain the architectural fin relative to the structure. The first mounting bracket comprises a first element having laterally opposed plates configured to receive the architectural fin therebetween and to apply a compression force to the laterally opposed surfaces of the architectural fin. The first mounting bracket comprises a second element connected to the first element so that the first element is rotatable relative to the second element about an axis of rotation of the first mounting bracket. The second element has a base for fixing the first mounting bracket relative to the structure. The first mounting bracket is configured to enable rotation of the architectural fin relative to the structure about the axis of rotation of the first mounting bracket.

In yet a further embodiment of the present inventions, the system for retaining a position of an architectural fin relative to a structure further comprises a hinge disposed between the first element and the second element. The hinge connects the first element and the second element. The hinge is configured to facilitate the rotation of the first element relative to the second element about the axis of rotation of the first mounting bracket.

In yet a further embodiment of the present invention, the first mounting bracket is biasable between a first configuration and a second configuration. In the first configuration the first element is fixed relative to the second element about the axis of rotation of the first mounting bracket and in the second configuration the first element is rotatable relative to the second element about the axis of rotation of the first mounting bracket.

In yet a further embodiment of the present invention, the system for retaining a position of an architectural fin relative to a structure further includes a lock for retaining the first mounting bracket in the first configuration wherein the first element is fixed relative to the second element about the axis of rotation of the first mounting bracket.

In yet a further embodiment of the present invention, the lock is biasable between a locked position wherein the first mounting bracket is biased to the first configuration and an unlocked position wherein the first mounting bracket is biased to the second configuration.

In yet a further embodiment of the present invention the lock is configured to be manually biased between the first position and the second position.

In yet a further embodiment of the present invention, the system for retaining a position of an architectural fin relative to a structure further includes a hinge disposed between the first element and the second element and thereby connecting the first element and the second element. The hinge is configured to facilitate the rotation of the first element relative to the second element about the axis of rotation of the first mounting bracket.

In yet a further embodiment of the present invention, the first element comprises a first group of one or more knuckles and the second element comprises a second group of one or more knuckles. The first group of one more knuckles is aligned with the second group of one or more knuckles to define a channel being collinear with the axis of rotation of the first mounting bracket.

In yet a further embodiment of the present invention, the system includes a pin extending along an axis between a first end and a second end, the pin received in the channel and being collinear with the first axis of rotation.

In yet a further embodiment of the present invention, the first group of one or more knuckles defines a first knuckle channel that extends along a first knuckle channel axis that is parallel to the axis of rotation of the first mounting bracket. The second group of one or more knuckles defines a second knuckle channel that extends along a second knuckle channel axis that is parallel to the axis of rotation of the first mounting bracket.

In yet a further embodiment of the present invention, the first knuckle channel axis collinear with the second knuckle channel axis when the first mounting bracket is biased to the first configuration.

In yet a further embodiment of the present invention, the system for retaining a position of an architectural fin relative to a structure further includes a locking pin for retaining the first mounting bracket in the first configuration wherein the first element is fixed relative to the second element about the axis of rotation of the first mounting bracket. The locking pin is configured to be received in the first knuckle channel and the second knuckle channel, thereby inhibiting rotation of the first element relative to the second element about the axis of rotation of the first mounting bracket.

The present invention resides in yet another aspect in a method of installing a system for retaining a position of an architectural fin. The method includes the step of providing an architectural fin having a system for retaining a position of the architectural fin relative to a structure according to the invention. The method further includes the step of installing the fin on the structure via the first mounting bracket. The method further includes the steps of biasing the installed first mounting bracket to the first configuration thereby fixing the rotation of the architectural fin relative to the structure.

In yet a further embodiment of the present invention, the system for retaining a position of an architectural fin relative to a structure further includes a second mounting bracket configured to retain the architectural fin relative to the structure. The second mounting bracket comprises a first element having laterally opposed plates configured to receive the architectural fin therebetween and to apply a compression force to the laterally opposed surfaces of the architectural fin. The second mounting bracket further comprises a second element connected to the first element so that the first element is rotatable relative to the second element about an axis of rotation of the first mounting bracket. The second element has a base for fixing the second mounting bracket relative to the structure. The second mounting bracket is configured to enable rotation of the architectural fin relative to the structure about the axis of rotation of the second mounting bracket.

In yet a further embodiment of the present invention, the axis of rotation of the first mounting bracket and the axis of rotation of the second mounting bracket are collinear.

DETAILED DESCRIPTION

Figure 1:
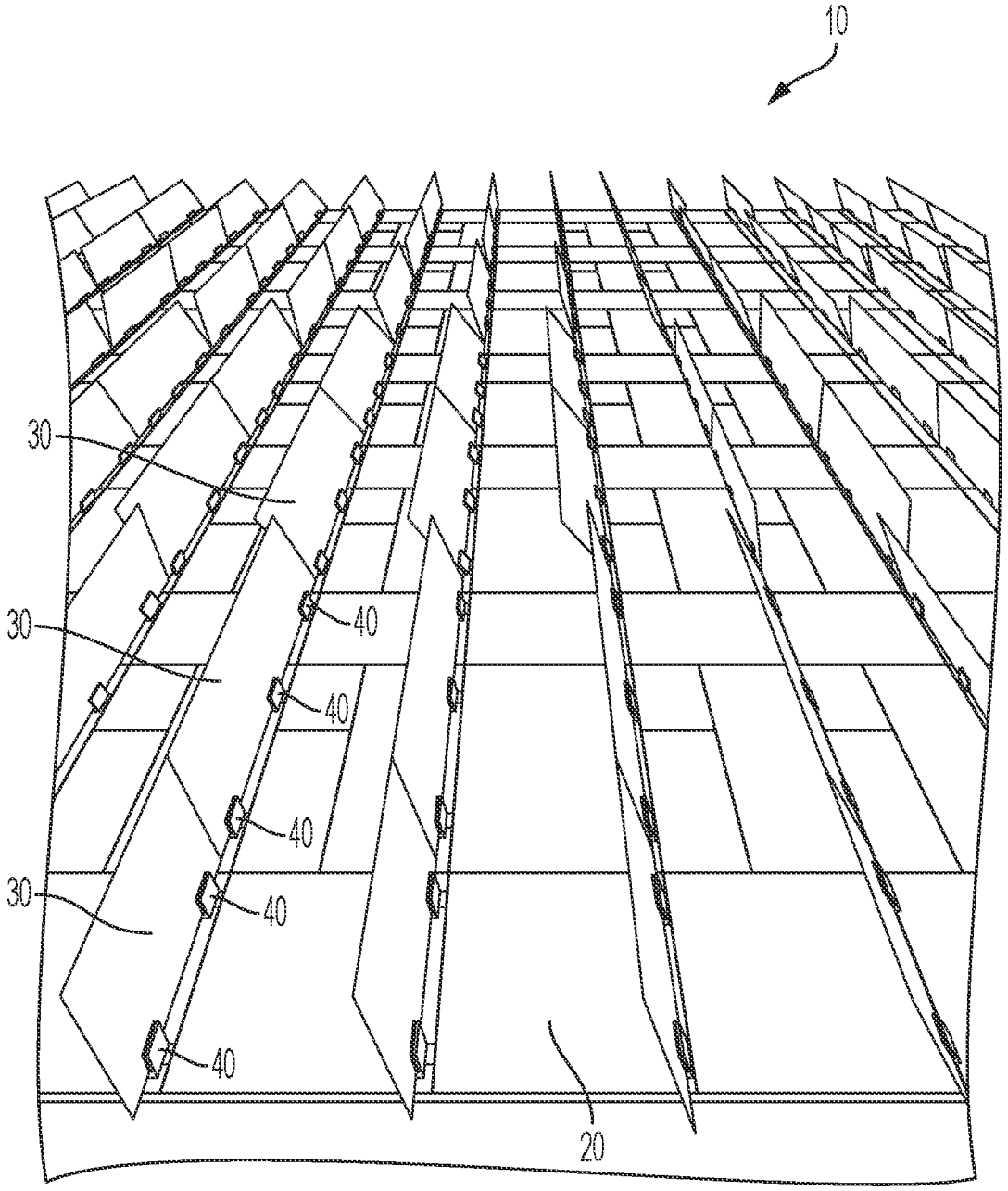
FIG. 1 illustrates a building façade with decorative fins in accordance with one embodiment of the present invention.

The present disclosure describes aspects of the present invention with reference to the exemplary embodiments illustrated in the drawings; however, aspects of the present invention are not limited to the exemplary embodiments illustrated in the drawings. It will be apparent to those of ordinary skill in the art that aspects of the present invention include many more embodiments. Accordingly, aspects of the present invention are not to be restricted in light of the exemplary embodiments illustrated in the drawings. It will also be apparent to those of ordinary skill in the art that variations and modifications can be made without departing from the true scope of the present disclosure. For example, in some instances, one or more features disclosed in connection with one embodiment can be used alone or in combination with one or more features of one or more other embodiments.

In reference to FIGS. 2-5, a system 100 for retaining a position of an architectural fin 110 relative to a structure is shown. The system 100 includes a first mounting bracket 112. The mounting bracket 112 includes a first element 120 and a second element 160. In the embodiment disclosed in FIG. 2, a hinge 140 is disposed between the first element 120 and the second element 160.

The architectural fin 110 is a generally planar structure that is fixed to façade of a structure for aesthetic or functional purposes. For example, the one or more fins 110 may be fixed to the side of a building to enhance the aesthetic appeal of the structure. An example is shown in FIG. 1. In some embodiments of the present invention, the fins provide a functional purpose. For example, the fins 110 may serve to block or reflect radiant heat, thereby affecting the environment inside the structure. The fins may also have a privacy function. Although several examples of use of the fins are disclosed herein, the present invention is not limited in this regard and a person of ordinary skill in the art and familiar with this disclosure will understand that the purpose of use of the fins may vary.

In reference to the FIGS., the fin 110 is generally planar. The fin defines an edge between two laterally opposed surfaces. The edge may extend along a straight line, as shown in the FIGS. In other embodiments the edge may be curved. In some embodiments of the present invention, the architectural fin 110 is made from glass. In yet other embodiments of the present invention, the fin 110 is made from wood. In yet other embodiments of the present invention, the fin 110 is a composite comprising two or more different types of materials. In yet another embodiment of the present invention, the fin 110 comprises metal. It will be understood by a person having ordinary skill in the art and familiar with this invention that the material of the fin may vary.

Figure 3:
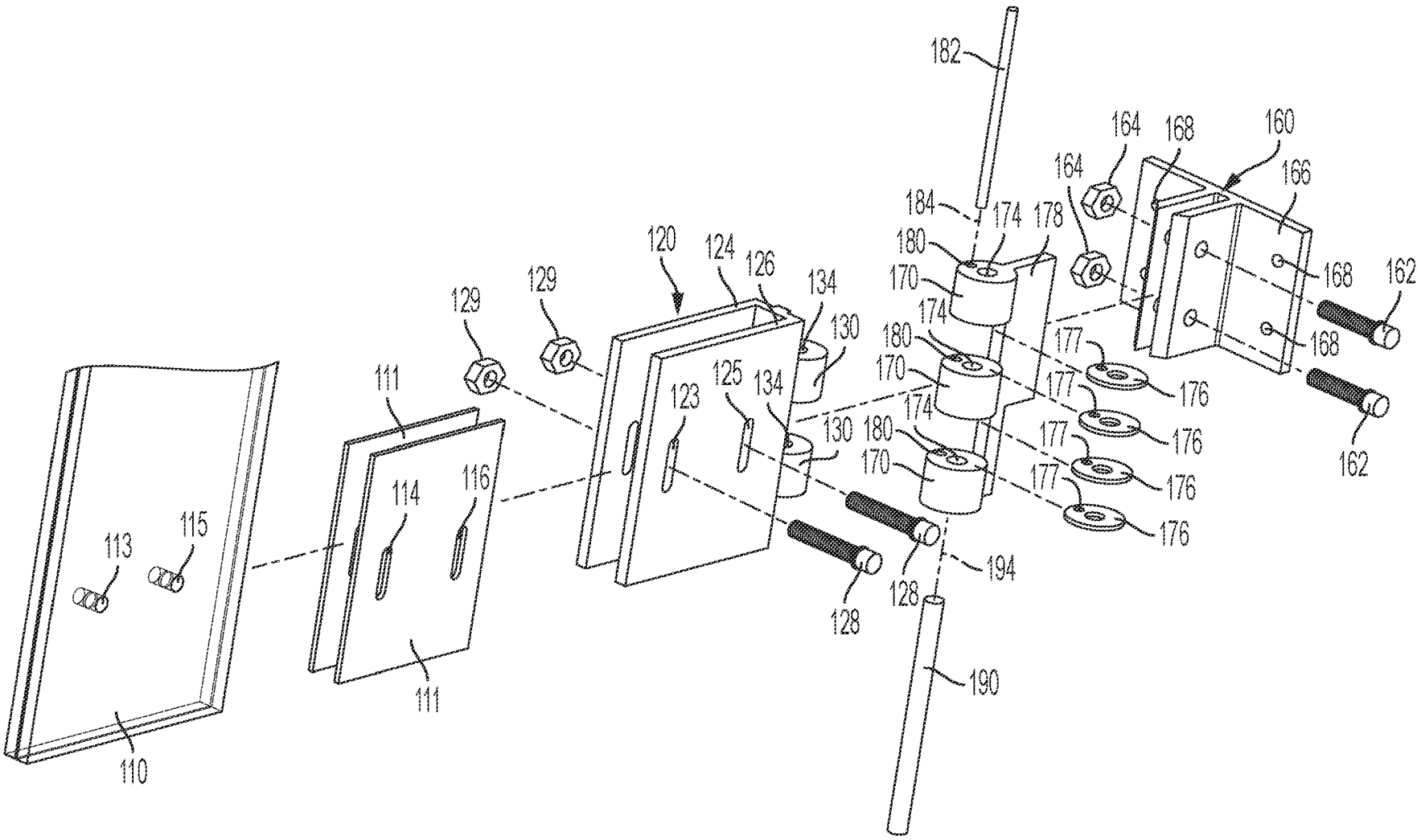
FIG. 3 illustrates an exploded perspective view of the embodiment disclosed in FIG. 2.
Figure 4:
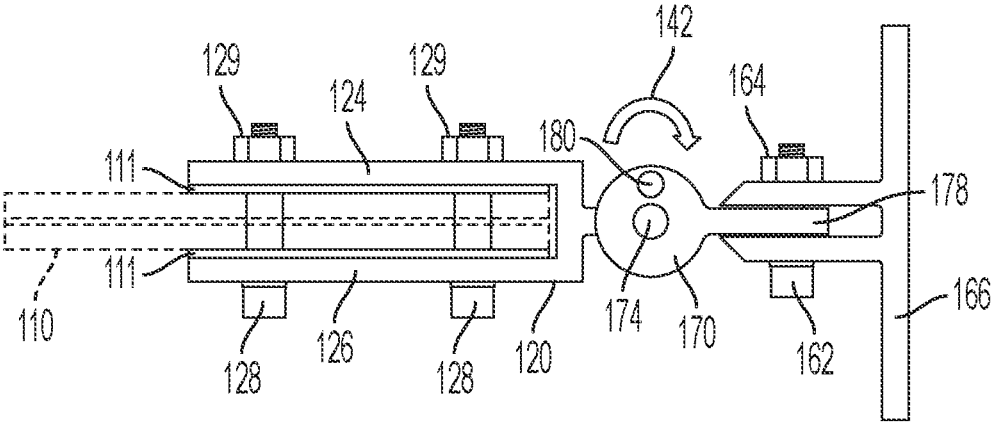
FIG. 4 illustrates a top view of the embodiment shown in FIG. 2.
Figure 5:
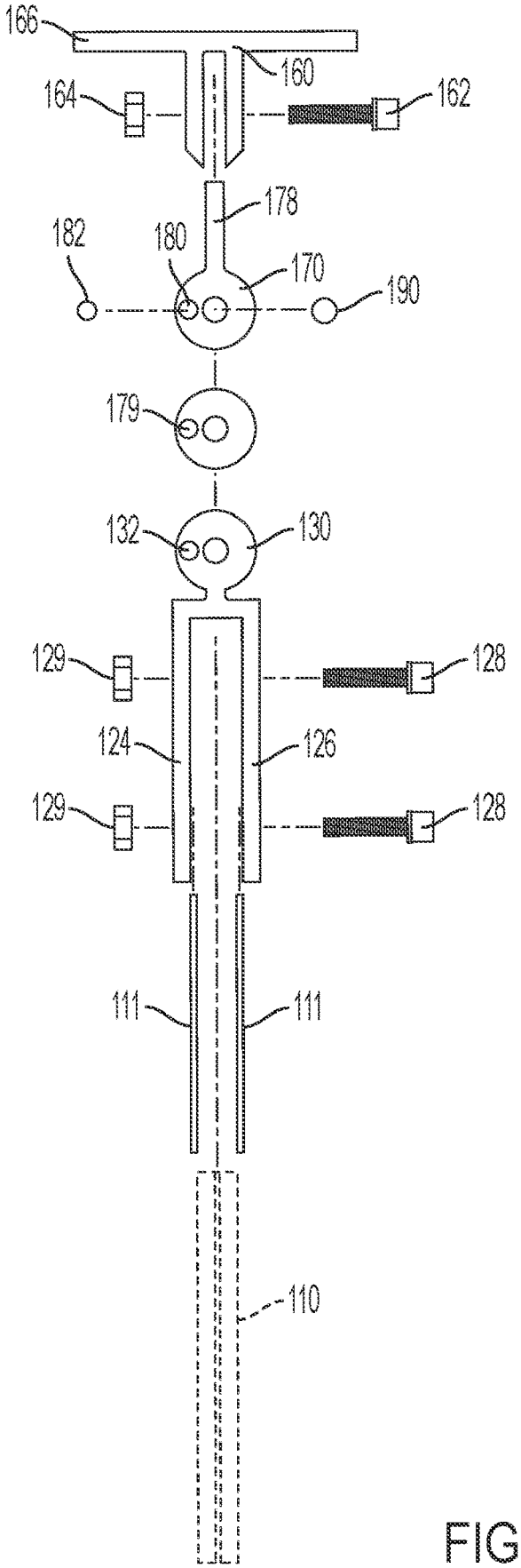
FIG. 5 illustrates an exploded top view of the embodiment shown in FIG. 2.
Figure 6:
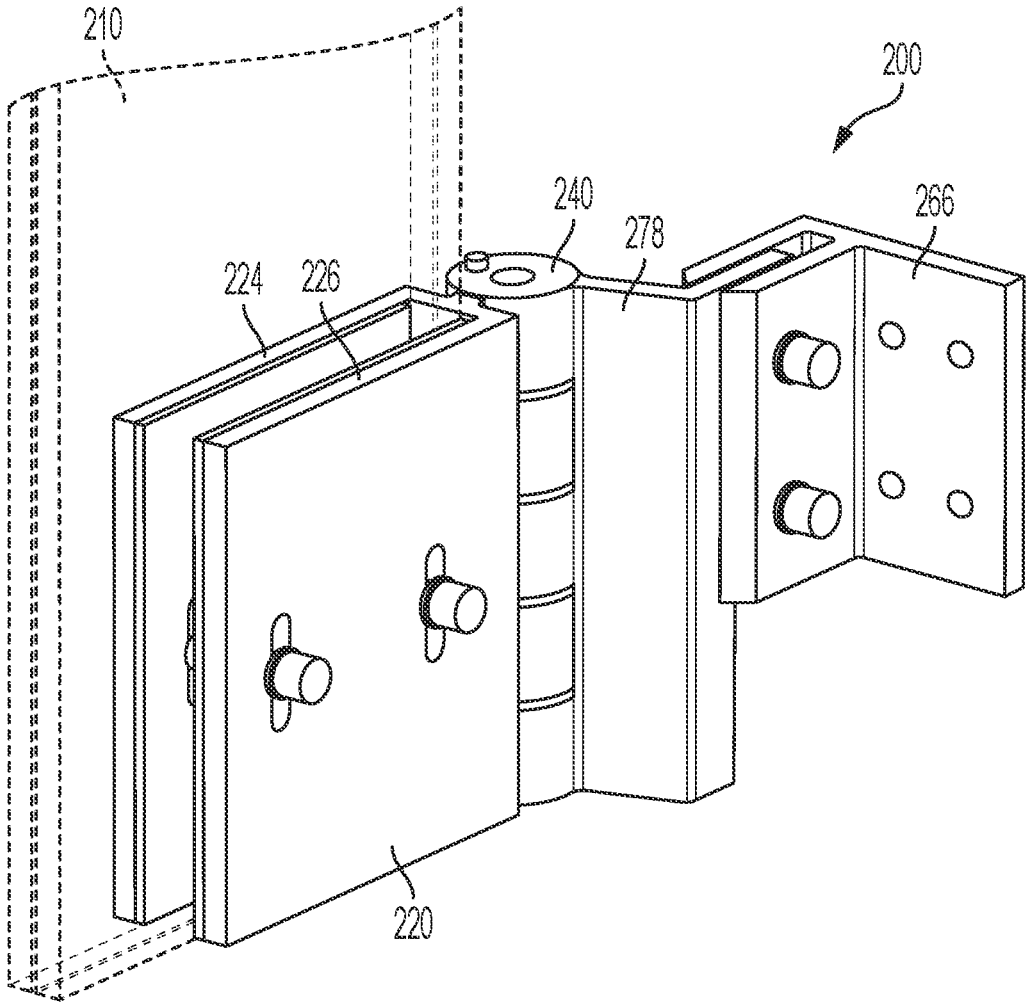
FIG. 6 illustrates a mounting system in accordance with one embodiment of the present invention.

The fin 110 is illustrated in FIG. 3. In the embodiment disclosed, the fin 110 comprises a first opening 113 extending between the laterally opposed surfaces. The fin 110 comprises a second opening 115 extending between the laterally opposed surfaces. The first opening 113 and the second open 115 are configured to receive fasteners therethrough so as to secure the fin 110 to the first element 120 of the mounting bracket 112.

The mounting bracket 112 includes a first element 120 having laterally opposed surfaces configured to receive the architectural fin 110 therebetween and to apply a compression force to the laterally opposed surfaces of the architectural fin 110. The laterally opposed surfaces 124, 126 of the first element 120 form a u-shaped mount in a plane perpendicular to an axis of rotation the first mounting bracket 112. Each side of the mount for receiving the fin 110, also referred to as plates, defines a generally planar surface for interfacing with the outer surface of the fin 110. The first plate 126 comprises holes 123, 125 extending through the surface thereof. The holes are configured to receive a fastener to generate a compression force on the first plate 126 and the second plate 124. In the embodiment disclosed in FIG. 2, the holes are ovalized so as to allow play in the positioning of the fin 110. The second plate 124 comprises corresponding through holes, although they are not shown in FIG. 2.

A portion of the fin 110 is received between the first plate 126 and the second plate 124. In some embodiments, an intermediate material 111 is disposed between the surface of the plate 126, 124 and the fin 110. The intermediate material may function to protect the fin from cracking or scratching generated by the plate when placed under compression. In yet other embodiments, the layer 111 inhibits a chemical fusion between the fin 110 and the plate elements 126, 124. For example, in circumstances when like materials are used for both the fin 110 and the first element 120. In the embodiment disclosed, the intermediate layer 111 includes through holes 114, 116 that correspond to those in the fin 110 and the first element 114, 116.

Figure 2:
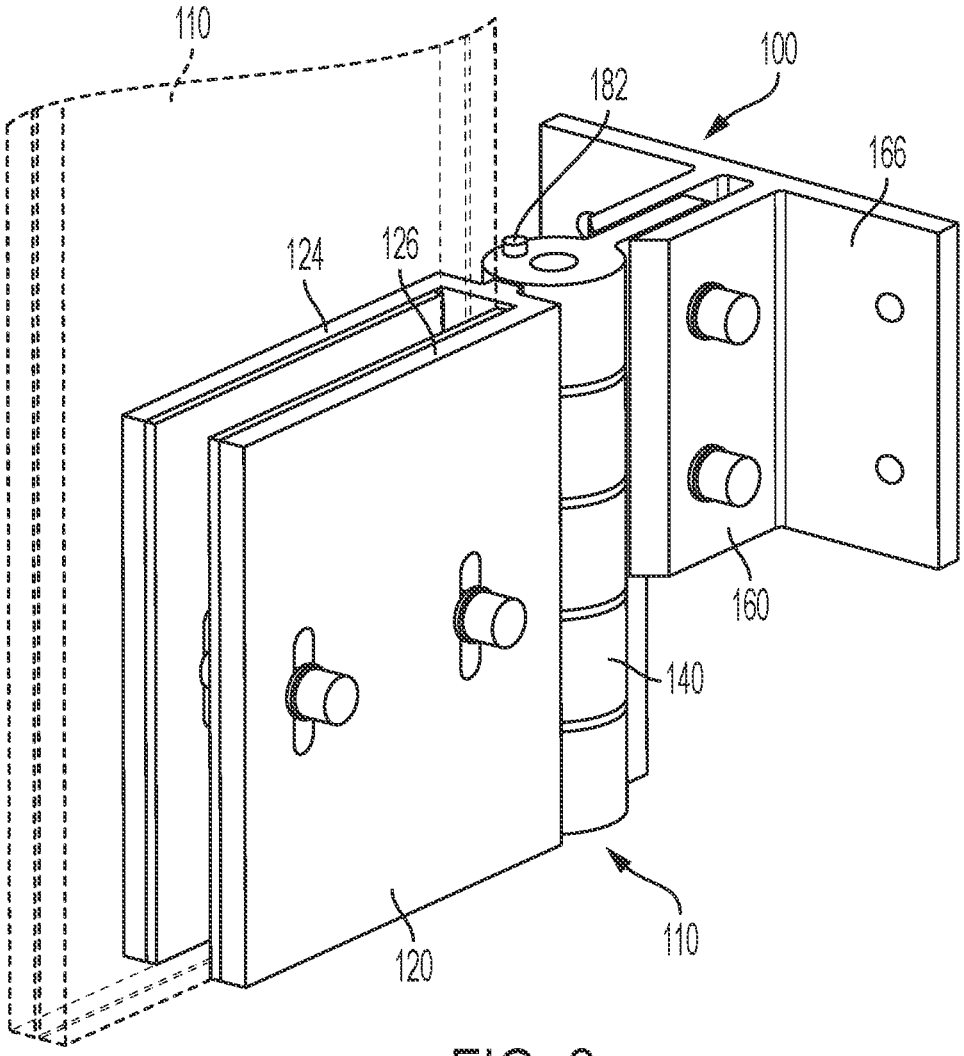
FIG. 2 illustrates a mounting system in accordance with one embodiment of the present invention.

In the embodiment disclosed in FIG. 2, the retaining structure is assembled by receiving the fin 110 between the opposing surfaces 126, 124 of the first element 120. The intermediate layer 111 is disposed between the fin 110 and the plates 126, 124. A fastener 128 is received through the respective holes that are in aligned arrangement. In the embodiment disclosed, the fastener 128 is threaded and has a head at one end. A nut 129 is received on the threads of the fastener 128 and tightened to a desired torque to generate a compression on the fin 110 between the two-plate surfaces 126, 124. In this manner, the fin 110 is retained in position relative to the mounting bracket 112. In this manner, the mounting bracket 112 can be used to fix the fin 110 relative to the structure. As will be understood by a person having skill in the art and being familiar with this disclosure, two or more mounting brackets may be used to fix a fin 100 relative to a structure to inhibit the fin 110 from generating a force moment on the mounting bracket 112.

The mounting bracket system 100 includes a second element 160 that is connected to the first element 120. The second element 160 includes a plate 166 for fixing the mounting bracket 112 to the façade of a structure. In the embodiment disclosed in FIG. 2, the second element 160 includes four holes 168 that extend through the plate 166. The holes 168 are configured for receiving fasteners for fixing the mounting bracket 112 to the structure. It will be understood by a person of ordinary skill in the art and familiar with the disclosure that the present invention is not limited in this regard and that other methods of fixing the mounting bracket system 100, and more specifically the second element 160, may be employed in accordance with the present invention. By way of nonlimiting example, the second element may be fixed to the structure using rivets or by welding.

In accordance with the present invention, the first element 120 is connected to the second element 160 so that the first element is rotatable relative to the second element about an axis of rotation 194 of the first mounting bracket 112. The mounting bracket 112 is configured to enable rotation of the architectural fin 110 relative to the structure about the axis of rotation 194 of the first mounting bracket 112. In this manner, a fin may be fixed to a structure. After the fin is fixed to the structure, the fin may be rotated relative to the structure about the axis of rotation of the mounting bracket. In some embodiments of the present invention, a fin is connected to the structure using a plurality of mounting brackets. In these embodiments, the axis of rotation of each mounting bracket is collinear, thereby enabling rotation of the fin relative to the structure. The inventors have discovered that by providing such a mounting system that enables relative rotation, they are able to provide improvements. For example, the inventors have discovered that this system allows for the mounting brackets to be preinstalled on the fins off-site, typically at the point of fin fabrication or assembly. The fins having the brackets preassembled thereon are delivered to the site of the structure. The fins are then fixed to the structure using the mounting brackets. During this installation process, the installers can adjust the rotation of the fin as necessary to facilitate installation thereof. After fixing the mounting brackets, the installers can rotate the fin to the position specified by the design. As described further herein, the fin can then be locked into position by a mechanical actuation or locking mechanism. Thereby fixing the relative rotation of the fin to the mounting bracket and thus structure.

In reference to the FIGS, a hinge 140 is disposed between the first element 120 and the second element 160. In some embodiments of the present invention, including those shown in FIGS. 2-6, the hinge 140 connects the first element 120 to the second element. It should be understood that the hinge 140 may be a separate element from the first element or the second element. In other embodiments, the hinge is integral with the first element and the second element of the mounting bracket. In yet other embodiments of the present invention, the hinge may comprise components that are integrated with one or more of the first element and the second element and may further comprise one or more elements that are distinct from the first element and the second element.

For example, in reference to FIGS. 2-6, the hinge 140 comprises a first group of knuckles 130. The knuckles are connected to the first element 120. The hinge 140 further comprises a second group of knuckles 170. The second group of one or more knuckles 170 is formed on a separate plate 178 that is connected to the second element 160. For example, in reference to FIG. 3, the second element 160 includes a u-shaped mounting bracket for receiving the mounting plate 178. The plate 178 is secured through one more transverse fasteners 162 through holes formed in the plate 178 (the holes are not shown in FIG. 3). In other embodiments of the present invention, the second group of knuckles 170 is integrated with the second element 160.

The first group of one or more knuckles 130 define a first plurality of holes 134 extending through each of the knuckles and being collinear. The second group of one or more knuckles 170 define a second plurality of holes 174 that extend through each of the knuckles and being collinear. When the hinge 140 is assembled, and the first group of one or more knuckles 130 is aligned with the second group of one or more knuckles 170, the holes therein 134, 174 define a channel that is collinear with the axis of rotation 194 of the first mounting bracket 112. A pin 190 is received in the channel, thereby fixing the position of the first element 120 relative to the second element 160 and thereby further facilitating rotation of the first element 120 relative to the second element 160 about the axis of rotation 194. While a specific type of mechanism for providing rotation of the first element 120 relative to the second element 160 is shown, the present invention is not limited in this regard. A person having ordinary skill in the art and familiar with the present disclosure will understand that other assemblies for enabling said relative rotation may be employed with the present invention.

In reference to FIG. 2, the embodiment disclosed there provides a plurality of washers 176 disposed between the mesh of knuckles. The washers enable relative rotation of the knuckle groups and inhibit friction and wear thereto.

The mounting bracket 120 is biasable between a first configuration and a second configuration. In the first configuration, the first element 120 is fixed relative to the second element 160 about the axis of rotation 194 of the first mounting bracket 112. In the second configuration, the first element 120 is rotatable relative to the second element 160 about the axis of rotation 194. In this manner, the operator can install and rotate the fin to a desired position. The operator can then bias the mounting bracket from the second configuration to the first configuration. Thereby fixing the first element 120 relative to the second element 160 about the axis of rotation. Thereby fixing the position of the fin relative to the structure mounted via the mounting bracket.

The mounting bracket 112 in accordance with the present invention includes a lock for retaining the first mounting bracket in the first configuration wherein the first element is fixed relative to the second element about the axis of rotation of the first mounting bracket. The lock is biasable between a locked position wherein the first mounting bracket is biased to the first configuration and an unlocked position wherein the first mounting bracket is biased to the second configuration.

In reference to FIGS., the first group of one or more knuckles 130 defines a first knuckle channel 132 that extends along a first knuckle channel axis that is parallel to the axis of rotation 194 of the first mounting bracket 120. The second group of one or more knuckles 170 defines a second knuckle channel 180 that extends along a second knuckle channel axis 182 that is parallel to the axis of rotation 194 of the first mounting bracket 112. The first knuckle channel axis is collinear with the second knuckle channel axis when the first mounting bracket is biased to the first configuration. A locking pin 182 for retaining the first mounting bracket 112 in the first configuration wherein the first element 120 is fixed relative to the second 160 element about the axis of rotation 194 of the first mounting bracket 112. The locking pin 182 is configured to be received in the first knuckle channel and the second knuckle channel 180, thereby inhibiting rotation of the first element 120 relative to the second element 160 about the axis of rotation of the first mounting bracket. In reference to the embodiment shown in FIG. 3, the washer 176 include holes 177 that align with the channel. In yet other embodiments of the present invention, the outside diameter of the washers is determined so that the radial extent of said washer does not interfere with the channel for receiving the locking pin 182.

In some embodiments, the channel is blind, thereby preventing the pin 182 from being drawn through the channel. In yet other embodiments, the pin 182 is retained in the channel 180 along the pin axis via a friction generated therein. In yet other embodiments of the present invention, a hairpin cotter or the like is installed on a distal end of the locking pin 182, thereby maintaining the locking pin in position.

Although a locking pin 182 is shown in the FIGS., the present invention is not limited in this regard and a person of ordinary skill in the art and familiar with the invention will understand that different types of locks may be used to bias the mounting bracket 112 to the first configuration wherein the first element 120 is fixed relative to the second element 160 about the axis of rotation 194. For example, in some embodiments a mechanical stop is provided. In yet other embodiments a fastener is provided wherein a friction is applied to the hinge pin 190 thereby inhibiting rotation thereof. In some embodiments of the present invention, the mounting bracket defines multiple locking points along the axis of rotation.

The system in accordance with the present invention may use two or more mounting brackets to position the fin relative to the structure. In these embodiments, the axis of rotation of each mounting bracket is collinear. One or more of the mounting brackets comprises the locking element.

When the mounting system is installed, the mounting bracket is fixed relative to the surface of a building. The decorative fin is rotatable relative to the surface of the building about the axis defined between the first element and the second element. In this manner, it is possible to adjust the relative angle of the decorative fin relative to the building after the decorative fin is installed.

The inventors have discovered that the mounting system in accordance with the present invention enables pre-assembly of the decorative fins off-site. In this manner, the system reduces labor associated with installation, especially on-site. The inventors have further discovered that the mounting system in accordance with the present invention enables ready cleaning and maintenance of the fins.

The hinge assembly in accordance with one embodiment is extruded in aluminum. It captures the glass fins and will work like a hinge to accommodate numerous different angles. In some embodiments of the present invention, the device will be attached to the curtain wall system instead of a concrete slab which will allow these fins to move with the curtain wall during seismic activities. The anchor bracket for the hinge assembly is factory-installed, affording better quality control and limiting field activity.

In one embodiment of the present invention, the hinge assembly features heavy-wall aluminum extrusions to accommodate the weight of the glass fins. The hinges assembly, being aluminum, can be painted to match the finish of the window wall system. The center pin is stainless steel. The stainless-steel locking pin is removable when the glass fin needs to be rotated. Nylon "washers" between hinge assembly knuckles allow for smooth and silent rotation of the fins, and cushion pads will be used between glass fin and aluminum hinge to protect glass.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications are hereby incorporated herein by reference in their entireties.

What is claimed is:

1. A system for retaining a position of an architectural fin relative to a structure, the architectural fin being generally planar and defining an edge extending between two laterally opposed surfaces, the system comprising:

a first mounting bracket configured to retain the architectural fin relative to the structure, the first mounting bracket comprising:

a first element having laterally opposed surfaces configured to receive the architectural fin therebetween and to apply a compression force to the laterally opposed surfaces of the architectural fin;

a second element connected to the first element so that the first element is rotatable relative to the second element about an axis of rotation of the first mounting bracket, the second element having a base for fixing the first mounting bracket relative to the structure;

wherein the first mounting bracket is configured to enable rotation of the architectural fin relative to the structure about the axis of rotation of the first mounting bracket;

wherein the first mounting bracket is biasable between a first configuration and a second configuration;

wherein in the first configuration the first element is fixed relative to the second element about the axis of rotation of the first mounting bracket and in the second configuration the first element is rotatable relative to the second element about the axis of rotation of the first mounting bracket;

wherein the first element comprises a first group of one or more knuckles that define a first knuckle channel that extends parallel to the axis of rotation of the first mounting bracket;

wherein the second element comprises a second group of one or more knuckles that define a second knuckle channel that extends parallel to the axis of rotation of the first mounting bracket;

wherein in the first configuration the first knuckle channel is coaxial with the second knuckle channel and a pin is received at least partially in the first knuckle channel and at least partially in the second knuckle channel, thereby fixing the rotation of the first element relative to the second element about the axis of rotation.

2. A system for retaining a position of an architectural fin relative to a structure according to claim 1, wherein the pin is configured to be manually inserted into the first knuckle channel and the second knuckle channel.

3. A system for retaining a position of an architectural fin relative to a structure according to claim 1, wherein the first group of one or more knuckles comprises two knuckles and the first knuckle channel extends at least partially through said two knuckles, and the second group of one or more knuckles comprises two knuckles and the second knuckle channel extends at least partially through said two knuckles.

4. A system for retaining a position of an architectural fin relative to a structure according to claim 1, wherein in the second configuration the pin is removed from the first knuckle channel and the second knuckle channel.

5. A system for retaining a position of an architectural fin relative to a structure according to claim 4, wherein the pin is biasable between a locked position wherein the first mounting bracket is biased to the first configuration and an unlocked position wherein the first mounting bracket is biased to the second configuration.

6. A system for retaining a position of an architectural fin relative to a structure according to claim 5, wherein the pin is configured to be manually biased.

7. A method of installing a system for retaining a position of an architectural fin relative to a structure according to claim 1, the method comprising the steps of:

providing an architectural fin having a system for retaining a position of the architectural fin relative to a structure according to claim 1 fixed thereto;

installing the fin on the structure via the first mounting bracket;

biasing the installed first mounting bracket to the first configuration thereby fixing the rotation of the architectural fin relative to the structure.

8. A system for retaining a position of an architectural fin relative to a structure according to claim 1, further comprising:

a second mounting bracket configured to retain the architectural fin relative to the structure, the second mounting bracket comprising:

a first element having laterally opposed surfaces configured to receive the architectural fin therebetween and to apply a compression force to the laterally opposed surfaces of the architectural fin;

a second element connected to the first element so that the first element is rotatable relative to the second element about an axis of rotation of the first mounting bracket, the second element having a base for fixing the second mounting bracket relative to the structure;

wherein the second mounting bracket is configured to enable rotation of the architectural fin relative to the structure about the axis of rotation of the second mounting bracket.

9. A system for retaining a position of an architectural fin relative to a structure according to claim 8, wherein the axis of rotation of the first mounting bracket and the axis of rotation of the second mounting bracket are collinear.

10. The system of claim 1, wherein the second knuckle channel is blind.

11. The system of claim 1, wherein a hairpin cotter is installed on a distal end of the pin thereby maintain the pin in position.

* * * * *